US008830025B2

(12) United States Patent
Nakano et al.

(10) Patent No.: US 8,830,025 B2
(45) Date of Patent: Sep. 9, 2014

(54) CIRCUIT BREAKER

(75) Inventors: Masaaki Nakano, Kounosu (JP); Kentaro Toyama, Saitama (JP); Makoto Osawa, Otawara (JP)

(73) Assignee: Fuji Electronic Fa Components & Systems Co., Ltd., Tokyo (JP)

( * ) Notice: Subject to any disclaimer, the term of this patent is extended or adjusted under 35 U.S.C. 154(b) by 280 days.

(21) Appl. No.: 13/381,290

(22) PCT Filed: Jun. 1, 2010

(86) PCT No.: PCT/JP2010/059256

§ 371 (c)(1),
(2), (4) Date: Feb. 9, 2012

(87) PCT Pub. No.: WO2011/024529

PCT Pub. Date: Mar. 3, 2011

(65) Prior Publication Data

US 2012/0152705 A1 Jun. 21, 2012

(30) Foreign Application Priority Data

Aug. 25, 2009 (JP) ..... 2009-193805

(51) Int. Cl.

| | |
|---|---|
| ***H01H 37/04*** | (2006.01) |
| ***H01H 71/08*** | (2006.01) |
| ***H01H 73/20*** | (2006.01) |
| *H01H 71/16* | (2006.01) |
| *H01H 9/52* | (2006.01) |

(52) U.S. Cl.

CPC ..... *H01H 71/08* (2013.01); *H01H 71/16* (2013.01); *H01H 9/52* (2013.01); *H01H 73/20* (2013.01)

USPC ..... 337/381; 337/113; 337/399; 439/722; 439/884; 439/887; 439/890; 361/707; 361/714

(58) Field of Classification Search

USPC ..... 337/290, 113, 381, 399; 200/284; 439/722, 884, 887, 890; 361/707, 714

See application file for complete search history.

(56) References Cited

U.S. PATENT DOCUMENTS

| | | | | |
|---|---|---|---|---|
| 1,327,844 | A * | 1/1920 | Schaefer | 439/739 |
| 2,806,215 | A | 9/1957 | Redslob | |
| 3,358,099 | A | 12/1967 | de Bellomayre | |

(Continued)

FOREIGN PATENT DOCUMENTS

| | | | |
|---|---|---|---|
| CN | 201282207 | Y | 7/2009 |
| DE | 1515533 | A1 | 7/1969 |

(Continued)

OTHER PUBLICATIONS

China Patent Office, "Office Action for 201080027745.7," Dec. 6, 2013.

Europe Patent Office, "Search Report for EP 10811582.5," May 9, 2014.

*Primary Examiner* — Anatoly Vortman

(74) *Attorney, Agent, or Firm* — Manabu Kanesaka

(57) ABSTRACT

A circuit breaker can minimize a change in a structure of a case when a material forming a stud is changed. A stud includes a base portion provided in the case and a protruding portion protruding from the case. A cross-sectional area of the protruding portion is more than that of the base portion; thereby a thermal conductivity of the protruding portion increases and the thermal conductivity from the protruding portion to an external conductor connected to the stud increases. In addition, since a surface area of the protruding portion increases, an amount of heat dissipated from the protruding portion increases. In the invention, since dimensions of the base portion inserted into a stud insertion hole of the case are not changed, it is not necessary to change the dimensions of the insertion hole of the case.

6 Claims, 6 Drawing Sheets

(56) References Cited

U.S. PATENT DOCUMENTS

| | | | | | |
|---|---|---|---|---|---|
| 3,988,053 | A | * | 10/1976 | Dodenhoff | 439/887 |
| 4,293,835 | A | | 10/1981 | Davis et al. | |
| 4,376,926 | A | * | 3/1983 | Senor | 337/104 |
| 4,454,493 | A | * | 6/1984 | Ubukata et al. | 337/368 |
| 4,912,598 | A | | 3/1990 | Grass | |
| 5,238,650 | A | * | 8/1993 | Sheller et al. | 422/174 |
| 6,692,841 | B2 | | 2/2004 | Shindo et al. | |

FOREIGN PATENT DOCUMENTS

| | | | | | |
|---|---|---|---|---|---|
| EP | 0923145 | A2 | | 6/1999 | |
| JP | 05-067424 | | | 3/1993 | |
| JP | H06-119869 | A | | 4/1994 | |
| JP | 07249362 | A | * | 9/1995 | H01H 73/20 |
| JP | 2004-127707 | | | 4/2004 | |
| JP | 2008-204863 | A | | 9/2008 | |
| WO | 2004/047227 | A1 | | 6/2004 | |

* cited by examiner

CIRCUIT BREAKER

RELATED APPLICATIONS

The present application is National Phase of International Application No. PCT/JP2010/059256 filed Jun. 1, 2010, and claims priority from Japanese Application No. 2009-193805, filed Aug. 25, 2009.

TECHNICAL FIELD

The present invention relates to a circuit breaker, such as a molded circuit breaker or an earth leakage breaker. In particular, the present invention relates to an improved circuit breaker capable of minimizing a change in the structure of, for example, a case even when a material forming a stud is changed.

BACKGROUND ART

A circuit breaker breaks a circuit and prevents the damage of an electric wire or an apparatus when a current with a predetermined value or more flows due to, for example, an overload or a short circuit. The circuit breaker includes a breaking mechanism portion that breaks a circuit with a bimetal when a current with a predetermined value or more flows and a terminal connected to the power supply side or the load side of the breaking mechanism portion. The breaking mechanism portion and the terminal are provided in the case. A stud connected to a power-supply-side line and a stud connected to a load-side line contact and are fixed to a power-supply-side terminal and a load-side terminal, respectively.

FIG. 6 is a diagram illustrating an example of the structure of a contact portion between the stud and the terminal of the circuit breaker.

When the stud 20 is a type (rear surface connection type) in which it contacts the terminal from the rear surface (the attachment surface of the circuit breaker) of the circuit breaker, the stud 20 has a columnar shape and has an end surface 20*a* contacting the terminal 40. A screw hole 23 is formed in the stud 20 so as to extend from the end surface 20*a* on the axis (for example, see Patent Literature 1).

The terminal 40 is formed by bending a strip-shaped conductive member and has a contact portion 41 contacting the stud 20 at one end of the terminal 40. One surface 41*a* of the terminal contacts the end surface 20*a* of the stud 20. A through hole 42 without a thread is formed in the contact portion 41 of the terminal 40.

An insertion hole 2*b* into which the end of the stud 20 is inserted is formed in the rear surface (the attachment surface of the circuit breaker) of the case 2. The diameter of the insertion hole 2*b* is designed according to the diameter of the stud 20. The terminal 40 is arranged in the case 2 such that the contact surface 41*a* faces the insertion hole 2*b*. The stud 20 is inserted into the insertion hole 2*b*, the end surface 20*a* contacts the contact surface 41*a* of the terminal 40, and the screw 27 is inserted into the through hole 42 of the terminal 40 and the screw hole 23 of the stud 20, thereby fastening and fixing the terminal 40 to the stud 20. A spring washer 28 and a washer 29 are interposed between the head of the screw 27 and the terminal 40.

In many cases, the stud 20 is made of copper with a high thermal conductivity. However, in recent years, in some cases, the material forming the stud 20 is changed to aluminum with a thermal conductivity less than that of copper. In the circuit breaker, the amount of heat transmitted to the bimetal needs to be constant. Therefore, when the thermal conductivity of the stud is changed, it is necessary to design a standard for adjusting the bimetal again. However, there is a limitation in the adjustment of the bimetal. When the amount of heat generated is equal to or more than a predetermined value, it is necessary to increase the diameter of the stud to dissipate heat.

However, as described above, the hole 2*b* formed in the rear surface of the case 2 is designed according to the diameter of the stud 20. When the diameter of the stud 20 increases, it is difficult to insert the stud into the hole 2*b* and it is necessary to prepare a separate case.

CITATION LIST

Patent Literature

Patent Literature 1: Japanese Patent Application Laid-Open No. H5-67424

DISCLOSURE OF THE INVENTION

Problem to be Solved by the Invention

The invention has been made in view of the above-mentioned problems and an object of the invention is to provide a circuit breaker capable of minimizing a change in the structure of, for example, a case even when a material (thermal conductivity) forming a stud is changed.

Means for Solving Problem

According to an aspect of the invention, there is provided a circuit breaker including a breaking mechanism portion that breaks a circuit with a bimetal when a current with a predetermined value or more flows; a terminal connected to a power supply side or a load side of the breaking mechanism portion; a columnar shaped stud having an end surface contacting and fixed to the terminal, and to which a power-supply-side line or a load-side line is connected; and a case accommodating the breaking mechanism portion, the terminal, and a portion of the stud. The stud includes a base portion accommodated in the case and a protruding portion protruding from the case. The cross-sectional area of the protruding portion is larger than the cross-sectional area of the base portion.

According to the above-mentioned aspect of the invention, since the cross-sectional area of the protruding portion of the stud is large, the thermal conductivity of the stud increases, and it is possible to increase the thermal conductivity from the protruding portion to an external conductor connected to the stud. In addition, since the surface area of the protruding portion increases, the amount of heat dissipated from the protruding portion also increases. As such, when the thermal conductivity increases, for example, during a change in the material forming the stud, the dimensions of the base portion inserted into the stud insertion hole which is provided in the case are not changed, but the cross-sectional area of only a portion (protruding portion) of the base portion which is not inserted into the stud insertion hole may increase. That is, it is not necessary to change the dimensions of the stud insertion hole provided in the case. Therefore, it is possible to minimize a change in the structure of a component even when the material forming the stud is changed.

In the circuit breaker according to the above-mentioned aspect, the stud may be formed by joining a first member forming at least the base portion and made of a material with a relatively high thermal conductivity with a second member connected to the first member and made of a material with a relatively low thermal conductivity.

In the invention, since the cross-sectional area of the base portion is less than that of the protruding portion, the base portion is likely to hinder the transmission of heat through the entire stud. However, since the base portion is made of a material with a thermal conductivity more than that of the protruding portion, it is possible to increase the thermal conductivity of the entire stud. Copper is an example of the material with a thermal conductivity more than that of aluminum. When copper is more expensive than aluminum and the entire stud is made of copper, a material cost increases. However, as in the above-mentioned structure, when the cross-sectional area of the protruding portion is more than that of the base portion and only the base portion is made of copper, it is possible to improve the thermal conduction performance of the base portion and the protruding portion while reducing a material cost.

In the circuit breaker according to the above-mentioned aspect, the first member and the second member may be joined to each other by any one of soldering, diffusion bonding, or welding.

In the circuit breaker according to the above-mentioned aspect, the first member and the second member may be joined to each other by co-fastening the first member with a fastening member fastening the terminal and the stud.

Since the terminal and the stud are made to contact each other and fastened together by the fastening member (screw), it is not necessary to provide a new means for fastening the first member and the second member.

Effects of the Invention

As can be seen from the above description, according to the invention, for example, when the material forming the stud is changed, the dimensions of the base portion inserted into the stud insertion hole which is provided in the case are not changed, and the cross-sectional area of only a portion (protruding portion) of the base portion which is not inserted into the stud insertion hole increases, thereby ensuring thermal conduction. Therefore, it is not necessary to change the dimensions of the stud insertion hole formed in the case. As a result, it is possible to provide a circuit breaker capable of minimizing a change in the structure of a component even when the material (thermal conductivity) forming the stud is changed.

When the base portion is made of a material with a thermal conductivity more than that of the protruding portion, it is possible to increase the thermal conductivity of the entire stud. When the entire stud is made of a material (for example, copper) with a thermal conductivity more than that of aluminum, a material cost increases. However, as in the invention, since the cross-sectional area of the protruding portion is more than that of the base portion and only the base portion is made of a material with a high thermal conductivity, it is possible to improve the thermal conduction performance of the base portion and the protruding portion while reducing the material cost.

BEST MODE FOR CARRYING OUT THE INVENTION

Hereinafter, exemplary embodiments of the invention will be described in detail with reference to the accompanying drawings.

First Embodiment

Figure 2:
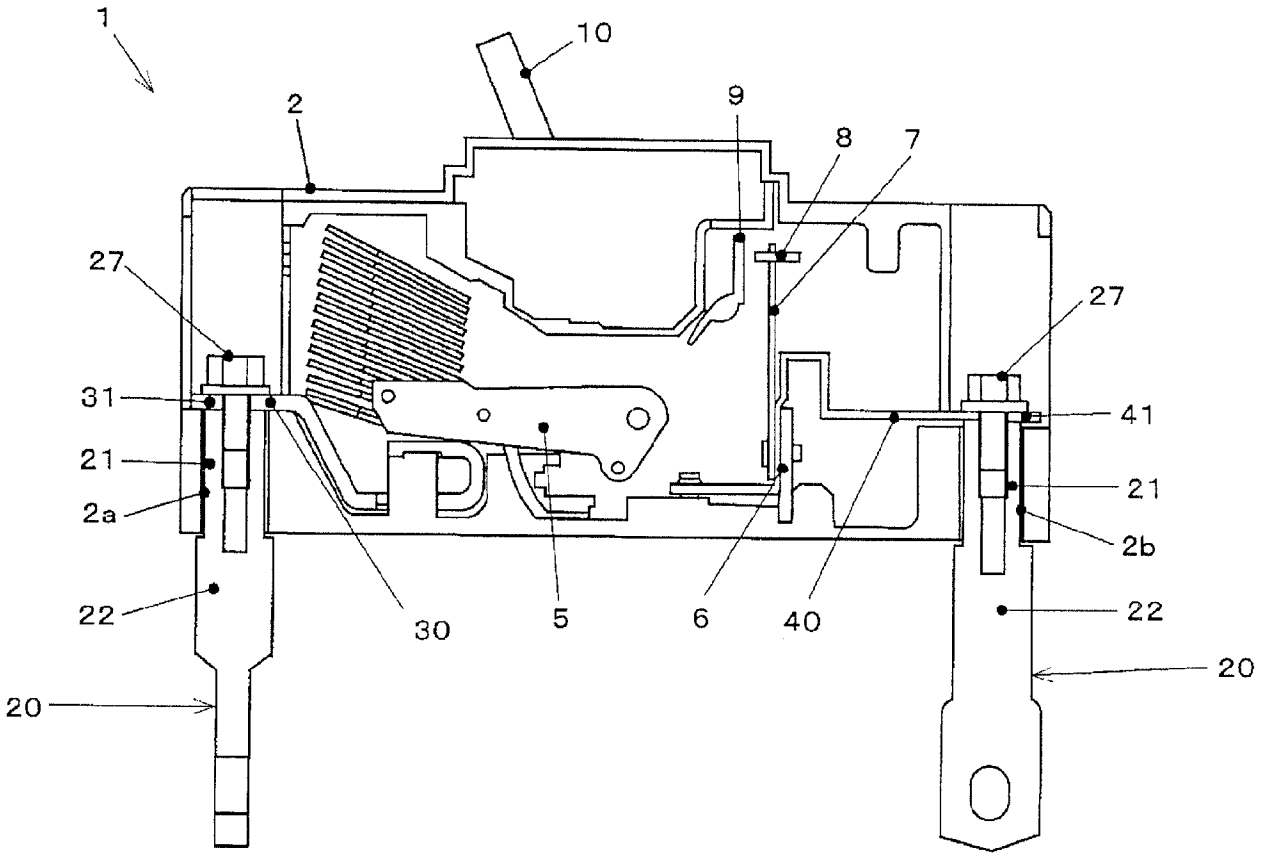
FIG. 2 is a side cross-sectional view illustrating the internal structure of the circuit breaker according to the first embodiment of the invention.
Figure 3:
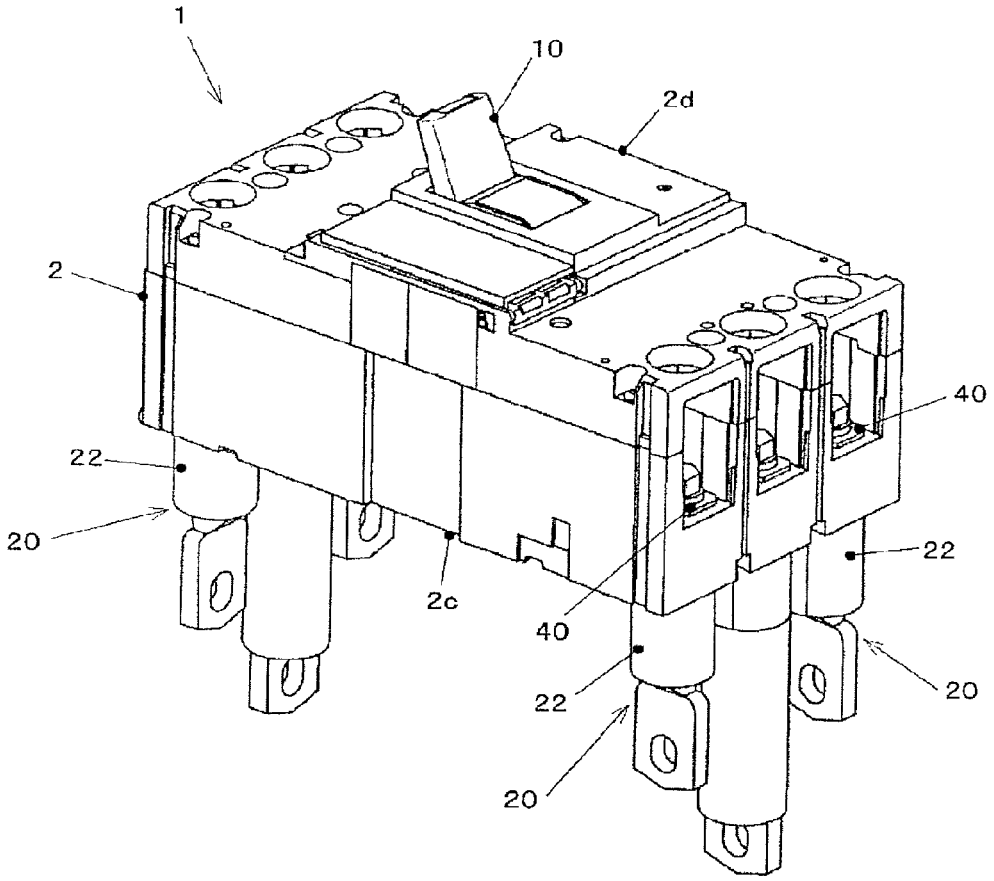
FIG. 3 is a perspective view illustrating the external appearance of the circuit breaker shown in FIG. 2.

As shown in FIG. 2 or FIG. 3, a circuit breaker 1 includes a case 2 with a rectangular parallelepiped shape. For example, a breaking mechanism portion that breaks a circuit when a current with a predetermined value or more flows, and terminals 30 and 40 connected to the power supply side or the load side of the breaking mechanism portion are provided in the case 2. The breaking mechanism portion includes, for example, a movable contact 5, a heater 6, and a bimetal 7. When a voltage is applied, a current sequentially flows through the power-supply-side terminal 30, the movable contact 5, a connection conductor (not shown), the heater 6, and the load-side terminal 40 having one end connected to the heater 6. Studs 20 are attached to the power-supply-side terminal 30 and the load-side terminal 40, which will be described in detail below.

The case 2 is made of a synthetic resin with a good insulating property. A handle 10 for manual operation is provided on a front surface 2*d* (a surface opposite to an attachment surface 2*c*) of the case 2.

Similarly to the above-mentioned example, the power-supply-side terminal 30 and the load-side terminal 40 are formed by bending a strip-shaped conductive member, and contact portions 31 and 41 contacting the end surfaces 20*a* of the studs 20 are formed at one end of each of the power-supply-side terminal 30 and the load-side terminal 40. Surfaces 31*a* and 41*a* of the contact portions 31 and 41 are contact surfaces with the end surfaces 20*a* of the studs 20. The terminals 30 and 40 are positioned at both ends of the case 2 such that the contact surfaces 31*a* and 41*a* face the attachment surface 2*c* of the case 2. In addition, through holes 2*a* and 2*b* are formed in the attachment surface 2*c* of the case 2 so as to face the contact surfaces 31*a* and 41*a* of each terminal. The studs 20 are inserted into the through holes 2*a* and 2*b*. The structure of the stud 20 will be described below.

The movable contact 5 is rotatably held such that a moving contact is contacted with or separated from a fixed contact and is turned on/off by a switching mechanism (not shown) including a latch or a latch catch. The movable contact 5 is pressed against a fixed contact (not shown) which is provided at the U-shaped leading end of the power-supply-side terminal 3 when the circuit breaker shown in FIG. 2 is in an on state.

The bimetal 7 is fixed to the base end of the heater 6. An adjustment screw 8 is attached to the upper end of the bimetal 7. The leading end of the adjustment screw 8 faces a trip crossbar 9 with a gap therebetween.

When a current flows to the circuit breaker 1, the heater 6 is operated to heat the bimetal 7. The bimetal 7 is bent such that the upper end thereof faces the left side of the drawings and the adjustment screw 8 approaches the trip crossbar 9. When an overcurrent flows to the circuit breaker 1, the amount of heat generated from the heater 6 is equal to or more than a predetermined value and the bimetal 7 is bent by a predetermined amount. Then, the trip crossbar 9 is rotated through the adjustment screw 8. Then, the movable contact 5 is disconnected from the U-shaped leading end of the power-supply-side terminal 3 by the switching mechanism and the circuit breaker 1 is turned on (trip operation).

Figure 1:
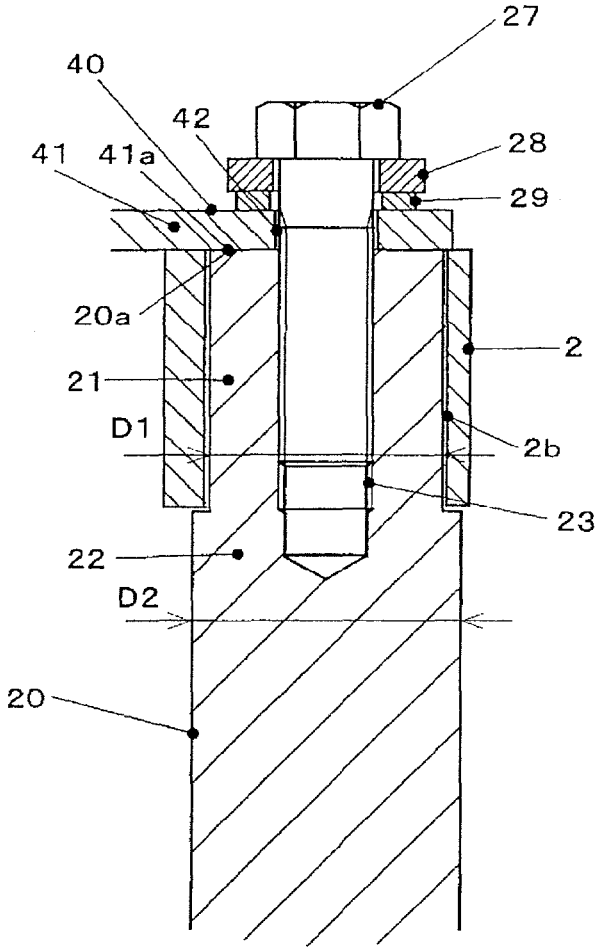
FIG. 1 is a diagram illustrating the structure of a connection portion between a stud and a terminal of a circuit breaker according to a first embodiment of the invention.

Next, the stud of the circuit breaker according to the first embodiment of the invention will be described with reference to FIG. 1. FIG. 1 shows a connection portion between the load-side terminal 40 and the stud 20 made of aluminum.

The stud 20 includes a base portion 21 that is inserted into the insertion hole 2*b* of the case 2 and a protruding portion 22 protruding from the case 2. An external conductor is connected to the leading end of the protruding portion 22. A screw hole 23 is formed in the base portion 21 so as to extend from the end surface on the axis. In the stud 20, the base portion 21 is inserted into the hole 2*b* formed in the rear surface of the case 2 and the end surface 20*a* contacts the contact surface 41*a* of the terminal 40. A screw 27 is inserted into the screw hole 23 formed in the base portion 21 of the stud 20 through the through hole 42 which is formed in the contact portion 41 of the terminal 40 to fasten the terminal 40 and the stud 20. A spring washer 28 and a washer 29 are interposed between the head of the screw 27 and the terminal 40.

As shown in FIG. 1, the diameter D1 of the base portion 21 is sufficient to be inserted into the insertion hole 2*b* formed in the case 2, and the diameter D2 of the protruding portion 22 is more than the diameter D1 of the base portion 21. That is, the cross-sectional area of the protruding portion 22 is more than that of the base portion 21.

As such, when the cross-sectional area of the protruding portion 22 of the stud 20 is large, the thermal conductivity of the stud increases, and the thermal conduction performance from the protruding portion 22 to the external conductor connected to the stud is improved. In addition, since the surface area of the protruding portion 22 increases, the amount of heat dissipated from the stud also increases.

The connection structure is the same as that between the power-supply-side terminal and the power-supply-side stud.

This embodiment described above may have the following effects.

When the material forming the stud is changed, for example, when the material forming the stud is changed to aluminum with a thermal conductivity less than that of copper and it is necessary to increase the thermal conductivity, a stud in which the cross-sectional area of only the protruding portion 22 protruding from the case 2 increases may be used. In this case, since the dimensions of the base portion 21 inserted into the stud insertion hole 2*b* of the case 2 do not vary, it is not necessary to change the dimensions of the insertion hole 2*b* of the case 2. Therefore, it is possible to minimize a change in the structure of a component even when the material forming the stud is changed.

Second Embodiment

Figure 4:
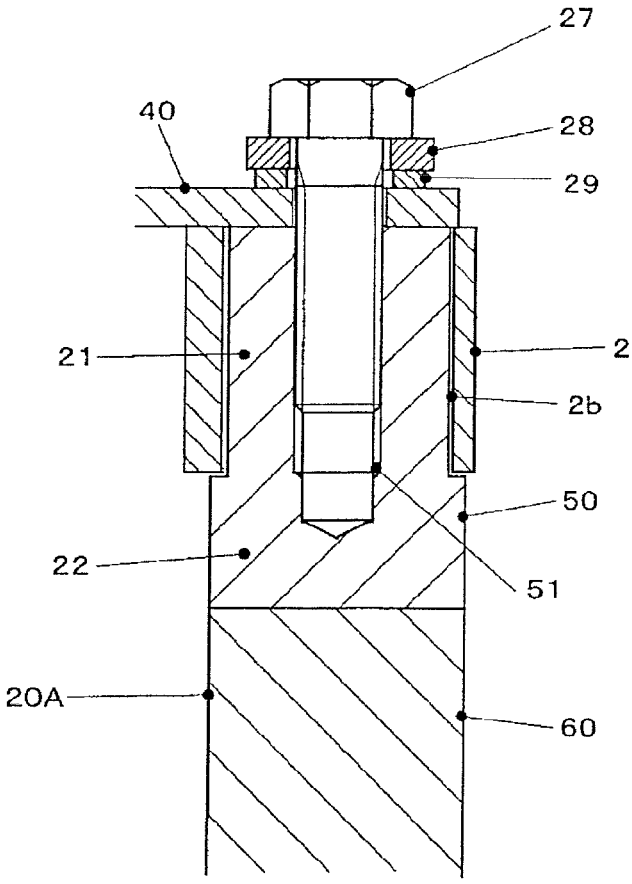
FIG. 4 is a diagram illustrating the structure of a connection portion between a stud and a terminal of a circuit breaker according to a second embodiment of the invention.

Next, a circuit breaker according to a second embodiment of the invention will be described with reference to FIG. 4.

A stud 20A of the circuit breaker according to this embodiment includes a base portion 21 that is inserted into an insertion hole 2*b* of a case 2 and a protruding portion 22 protruding from the case 2. The diameter of the protruding portion 22 is more than that of the base portion 21. The stud 20A is formed by bonding two members, that is, a first member 50 that includes the base portion 21 and a part of the protruding portion 22 close to the base portion 21 and a second member 60 that includes the other part of the protruding portion 22. A screw hole 51 is provided in the end surface of the first member 50 so as to extend on the axis. The first member 50 is made of a material (for example, copper) with a high thermal conductivity and the second member 60 is made of a material (for example, aluminum) with a low thermal conductivity. The first member 50 and the second member 60 are bonded to each other by a bonding method capable of transmitting heat, such as soldering, diffusion bonding, or welding.

This embodiment may have the following effects in addition to the effects of the first embodiment.

(1) Since the cross-sectional area of the base portion 21 is less than that of the protruding portion 22, the base portion 21 is likely to hinder the transmission of heat through the entire stud. However, in this embodiment, since the base portion 21 (including a part of the protruding portion 22) is made of a material (copper) with a high thermal conductivity, the thermal conductivity of each of the base portion 21 and the protruding portion 22 is improved and it is possible to rapidly transmit heat to an external conductor connected to the protruding portion 22.

(2) When the entire stud is made of copper, a material cost increases. However, in this embodiment, since the base portion 21 (first member 50) including a part of the protruding portion 22 is made of copper, it is possible to improve the thermal conduction performance of the base portion 21 and the protruding portion 22 while reducing a material cost.

Third Embodiment

Figure 5:
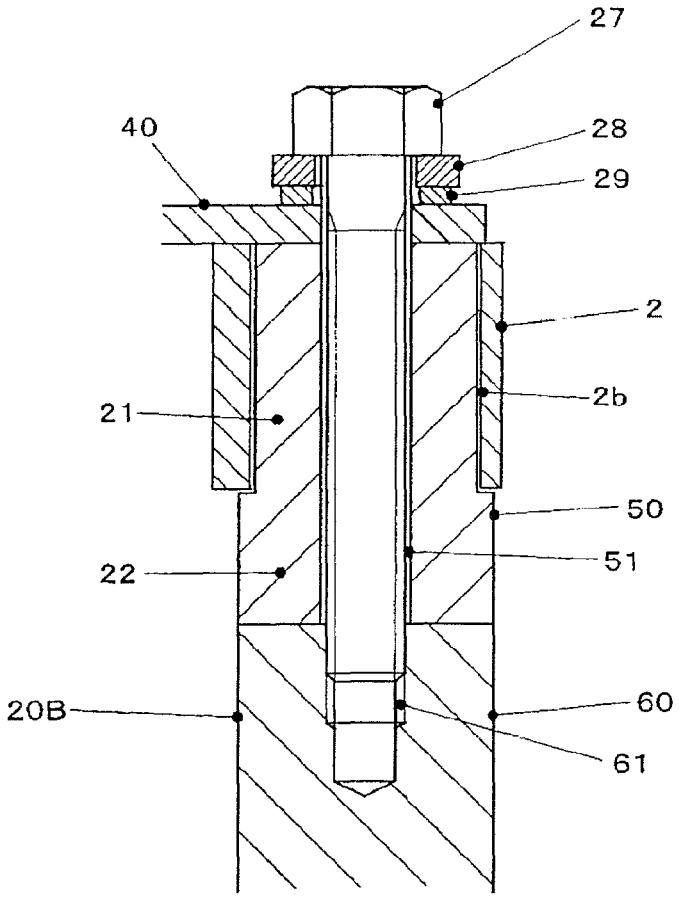
FIG. 5 is a diagram illustrating the structure of a connection portion between a stud and a terminal of a circuit breaker according to a third embodiment of the invention.
Figure 6:
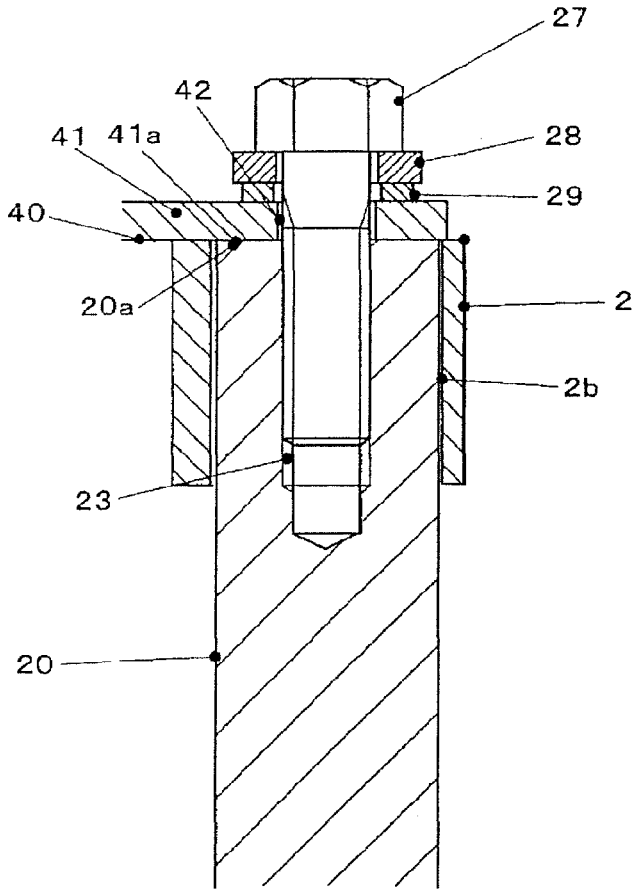
Fig. 6 Prior Art
FIG. 6 is a diagram illustrating an example of the structure of a connection portion between a stud and a terminal of a circuit breaker.

Next, a circuit breaker according to a third embodiment of the invention will be described with reference to FIG. 5.

A stud 20B of the circuit breaker according to this embodiment includes a base portion 21 inserted into an insertion hole 2*b* of a case 2 and a protruding portion 22 protruding from the case 2. The diameter of the protruding portion 22 is more than that of the base portion 21. Similarly to the stud 20A according to the second embodiment, the stud 20B includes a first member 50 that includes the base portion 21 and a part of the protruding portion 22 close to the base portion 21 and a second member 60 that includes the other part of the protruding portion 22. In this embodiment, the stud 20B is formed by fastening and fixing two members 50 and 60. The first member 50 is made of a material (for example, copper) with a high thermal conductivity, and a through hole (clearance hole) 51 into which a screw 27 is inserted is formed on the axis in the first member 50. The second member 60 is made of a material (for example, aluminum) with a low thermal conductivity and a screw hole 61 is formed in the second member 60 so as to extend from the end surface on the axis.

In this embodiment, the screw 27 for fastening the terminal 40 and the stud 20B is used to fasten the first member 50 and the second member 60. That is, the screw 27 is inserted into the through hole 51 of the first member 50 through the through hole 42 of the terminal 40 and is then inserted into the screw hole 61 of the second member 60, thereby fastening the first member 1. In this way, the terminal 40 is fastened to the stud 20B. In this case, since the lower surface of the first member 50 comes into close contact with the upper surface of the second member 60, the thermal conduction between the contact surfaces of the first and second members is not hindered.

This embodiment may have the following effects.

Since the first member 50 and the second member 60 are fastened by the screw 27 that fastens the terminal 40 and the stud 20B, it is not necessary to provide a new means for fastening the first member 50 and the second member 60.

Other Embodiments

The invention is not limited to the above-described embodiments, but various applications or modifications are considered. For example, the structure of the circuit breaker, the shape of each component, and the material forming each component are not limited to the above-described embodiments, but can be appropriately changed. In addition, in the above-described embodiment, the first member and the second member of the stud are made of copper and aluminum, respectively. However, the first and second members may be made of other materials.

REFERENCE NUMERALS

1: CIRCUIT BREAKER
2: CASE
2*a*, 2*b*: THROUGH HOLE
2*c*: ATTACHMENT SURFACE
2*d*: FRONT SURFACE
5: MOVABLE CONTACT
6: HEATER
7: BIMETAL
8: ADJUSTMENT SCREW
9: TRIP CROSSBAR
20: STUD
20*a*: END SURFACE
21: SCREW HOLE
23: SCREW HOLE
27: SCREW
28: SPRING WASHER
29: WASHER
30: POWER-SUPPLY-SIDE TERMINAL
40: LOAD-SIDE TERMINAL
41: CONTACT PORTION
41*a*: CONTACT SURFACE
42: THROUGH HOLE
50: FIRST MEMBER
51: THROUGH HOLE
60: SECOND MEMBER
61: SCREW HOLE

What is claimed is:

1. A circuit breaker comprising:

a breaking mechanism portion breaking a circuit with a bimetal when a current with a predetermined value or more to break the circuit flows;

a terminal connected to a power supply side or a load side of the breaking mechanism portion;

a case accommodating the breaking mechanism portion, and the terminal;

a columnar shaped stud including a first member having a base portion accommodated in the case with an end surface fixed in a state contacting the terminal and a lower portion connected to the base portion and protruding from the case, and a second member fixed to the lower portion and connected to a power-supply-side line or a load-side line, the lower portion and the second member forming a protruding portion protruding from the case; and a fastening member engaging the second member to fasten the terminal and the stud, wherein a cross-sectional area of the protruding portion is more than a cross-sectional area of the base portion.

2. A circuit breaker according to claim 1, wherein the first member is made of a material with a first thermal conductivity, and the second member is made of a material with a second thermal conductivity lower than the first thermal conductivity.

3. A circuit breaker according to claim 1, wherein the protruding portion has a portion protruding annually relative to the base portion and positioned under a bottom surface of the case accommodating the base portion.

4. A circuit breaker according to claim 1, wherein the fastening member has a screw portion, and the second member has a screw hole; and the screw portion is engaged with the screw hole to fix the first member between the terminal and the second member.

5. A circuit breaker according to claim 4, wherein the terminal has a first through hole, and the first member has a second through hole; and the first through hole, the second through hole and the screw hole are coaxially formed to inset the fastening member therein.

6. A circuit breaker according to claim 1, wherein the base portion and the lower portion are integrally connected as one member.

* * * * *